US005411047A

United States Patent [19]

Reilly

[11] Patent Number: 5,411,047

[45] Date of Patent: May 2, 1995

[54] MODULAR STRUCTURAL ELEMENTS

[76] Inventor: Robert M. Reilly, 810 Barry St., Miami, Fla. 33140

[21] Appl. No.: 888,355

[22] Filed: May 22, 1992

[51] Int. Cl.[6] ..... E04H 15/44

[52] U.S. Cl. ..... 135/127; 52/81.1

[58] Field of Search ..... 135/101, 102, 106, 114, 135/87, 909; 52/80.1, 80.2, 81.1, 81.2, 63

[56] References Cited

U.S. PATENT DOCUMENTS

| | | | |
|---|---|---|---|
| 2,914,074 | 12/1959 | Fuller | 135/1 |
| 3,059,658 | 10/1962 | Finlayson . | |
| 3,203,144 | 8/1965 | Fuller . | |
| 3,354,591 | 11/1967 | Fuller . | |
| 3,376,879 | 4/1968 | Huddle | 135/106 X |
| 3,807,421 | 4/1974 | Geiger et al. | 135/1 R |
| 3,886,961 | 6/1975 | Geiger et al. | 135/1 R |
| 3,961,638 | 6/1976 | Huddle | 135/4 R |
| 3,973,364 | 8/1976 | Seaman | 52/57 |
| 4,028,861 | 6/1977 | Huddle | 52/745 |
| 4,036,244 | 7/1977 | Huddle | 135/4 R |
| 4,063,566 | 12/1977 | Millerioux | 135/1 R |
| 4,092,992 | 6/1978 | Huddle | 135/3 R |
| 4,096,669 | 6/1978 | Pabst | 52/63 |
| 4,118,904 | 10/1978 | Sprung | 52/63 |
| 4,265,260 | 5/1981 | Gillis | 135/3 R |
| 4,284,094 | 8/1981 | Behrend | 135/3 R |
| 4,393,887 | 7/1983 | Orobin . | |
| 4,583,331 | 4/1986 | Hunt et al. | 52/2 |
| 4,593,710 | 6/1986 | Stafford et al. | 135/102 |
| 4,608,789 | 9/1986 | Willis | 52/81 |
| 4,644,706 | 2/1987 | Stafford et al. | 52/63 |
| 4,649,947 | 3/1987 | Tury et al. | 135/97 |
| 4,682,450 | 7/1987 | Diamond | 52/81 |
| 4,711,062 | 12/1987 | Gwilliam et al. | 52/646 |
| 4,722,162 | 2/1988 | Wilensky | 52/648 |
| 4,796,394 | 1/1989 | Chastain | 52/81 |
| 4,809,726 | 3/1989 | Gillis | 135/109 |
| 5,117,852 | 6/1992 | Bryant | 135/104 |
| 5,234,011 | 8/1993 | Lynch | 135/114 X |

OTHER PUBLICATIONS

E. M. Hatton, "The Tent Book, " 1979, pp. 128, 133, 212, 218.

*Primary Examiner*—Lanna Mai

*Attorney, Agent, or Firm*—Malin, Haley, DiMaggio & Crosby

[57] ABSTRACT

A modular tent structure capable of withstanding high winds by minimizing the aerodynamic forces on the structure by use of a sectional design which acts through a series of negatively cambered air foils. A covering fabric is suspended between structural supports of the tent to provide a variety of patterns. Each pattern is subsequently based on a four, six, or eight-sided geodetic support member arrangement raised to common apical coupling points.

1 Claim, 10 Drawing Sheets

MODULAR STRUCTURAL ELEMENTS

FIELD OF THE INVENTION

This invention relates generally to modular structural elements, and more particularly, relates to modular frame structures having flexible sheet panels attached thereto forming tent, roof or container elements or the like, capable of sustaining high wind, hydrostatic, or vacuum loading.

BACKGROUND OF THE INVENTION

Like conventional structural components, tent-like structures are capable of sheltering most objects against the elements. However, unlike conventional structural components, tent-like structures usually employ a fabric covering held in place by a series of support members. The flexible sheet panels used in such structures have a number of advantages over conventional rigid structural panels such as low overall weight and costs of construction, installation and maintenance. Such flexible coverings include woven or extruded skins of cotton, canvas, polyethylene, acrylic ester, vinyl, glass or similar materials.

A serious problem inherent in tent-like structures is their inability to withstand the substantial aerodynamic lift forces generated under high wind conditions. The substantial efforts at providing modular structural members which can be combined to create expansive cover structure is evidenced in the prior art. However, the Applicant is not aware of any effort which has successfully countered the aerodynamic lift phenomenon caused by high wind loading.

The instant invention is therefore directed to a tent-like structure employing securely fastened flexible sheet panels spanning rigid structural frame members in such a way that the modular structural element created thereby is capable of withstanding extreme downloading and uploading forces by use of symmetrically upwardly and downwardly directed airfoil sections. These characteristics also lend it to being combined into structures adaptable to use in space.

SUMMARY OF THE INVENTION

The instant invention is directed to modular structural elements which may be configured as tent-like structures capable of withstanding high winds by minimizing the aerodynamic forces imparted on the tent covering material by innovative structural and covering geometric organization. The invention is directed to three main embodiments: an eight-sided, six-sided, and four-sided main structure, the eight-sided and six-sided structures each disclosed in two subembodiments.

Each embodiment comprises a plurality of elongated structural supports which terminate at common apical coupling points depending on the desired configuration. A covering fabric is suspended between the covering points and drawn into a plurality of curved sections which assist in reducing aerodynamic loading on the entire assembly by acting as a series of negatively cambered air foils.

It is a principal object of the instant invention to provide modular structural elements which can be combined in a variety of patterns to create a structural composite panel capable of withstanding extreme windloading.

It is an additional object of the present invention to provide modular structural elements which may be configured in a variety of different patterns to maximize the available space when housing objects in tent-like container structures.

It is yet another object of the present invention to provide a modular tent assembly that maximizes the benefits of reduced aerodynamic uploading in high winds while minimizing the necessary amount of covering material.

DETAILED DESCRIPTION OF THE PREFERRED EMBODIMENT

Figure 1:
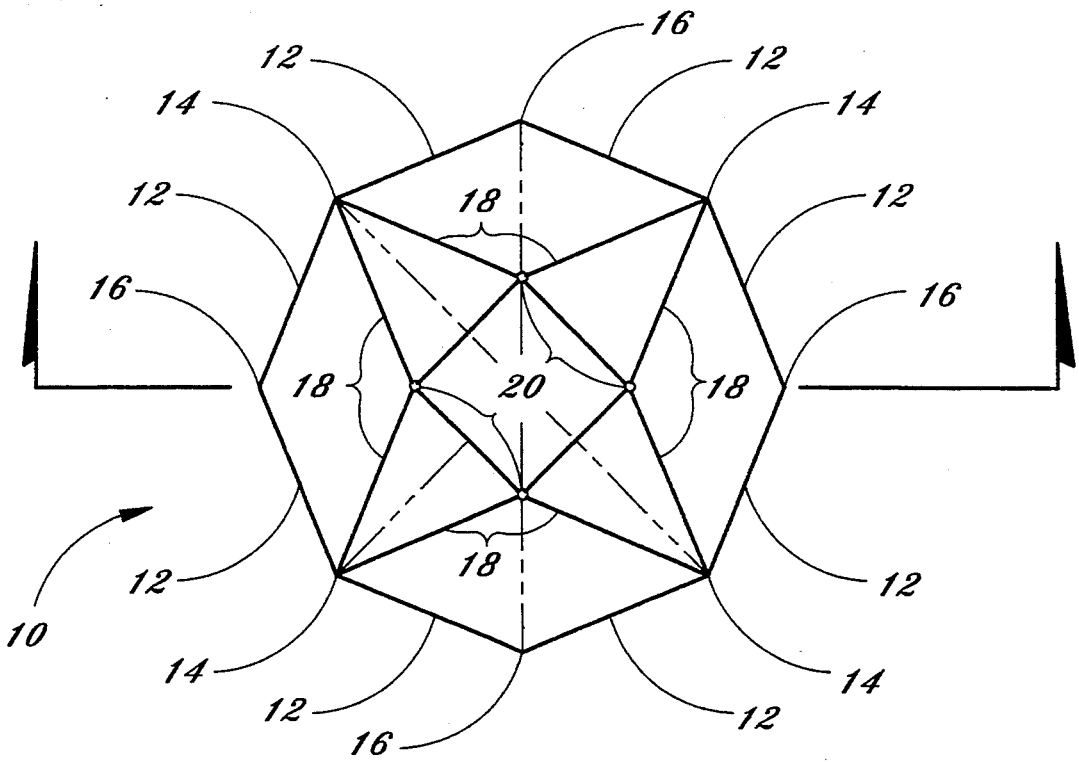
FIG. 1 is a plan view of a single octagonal tent structure.

With reference to the several views of the drawings, there are depicted three main embodiments of a geodetic tent structure utilizing an eight-sided, six-sided, and four-sided basic structure.

The eight-sided tent structure may be constructed in either of two basic embodiments, the first thereof adapted to comprise a plurality of individual modules generally characterized by the reference numeral 10, and the second thereof adapted to stand alone as a single module denoted by the reference numeral 10'.

Figure 2:
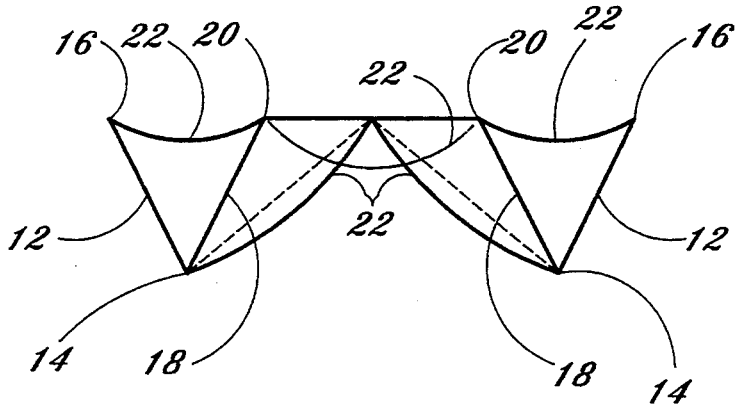
FIG. 2 is a sectional view of the embodiment in FIG. 1.
Figure 3:
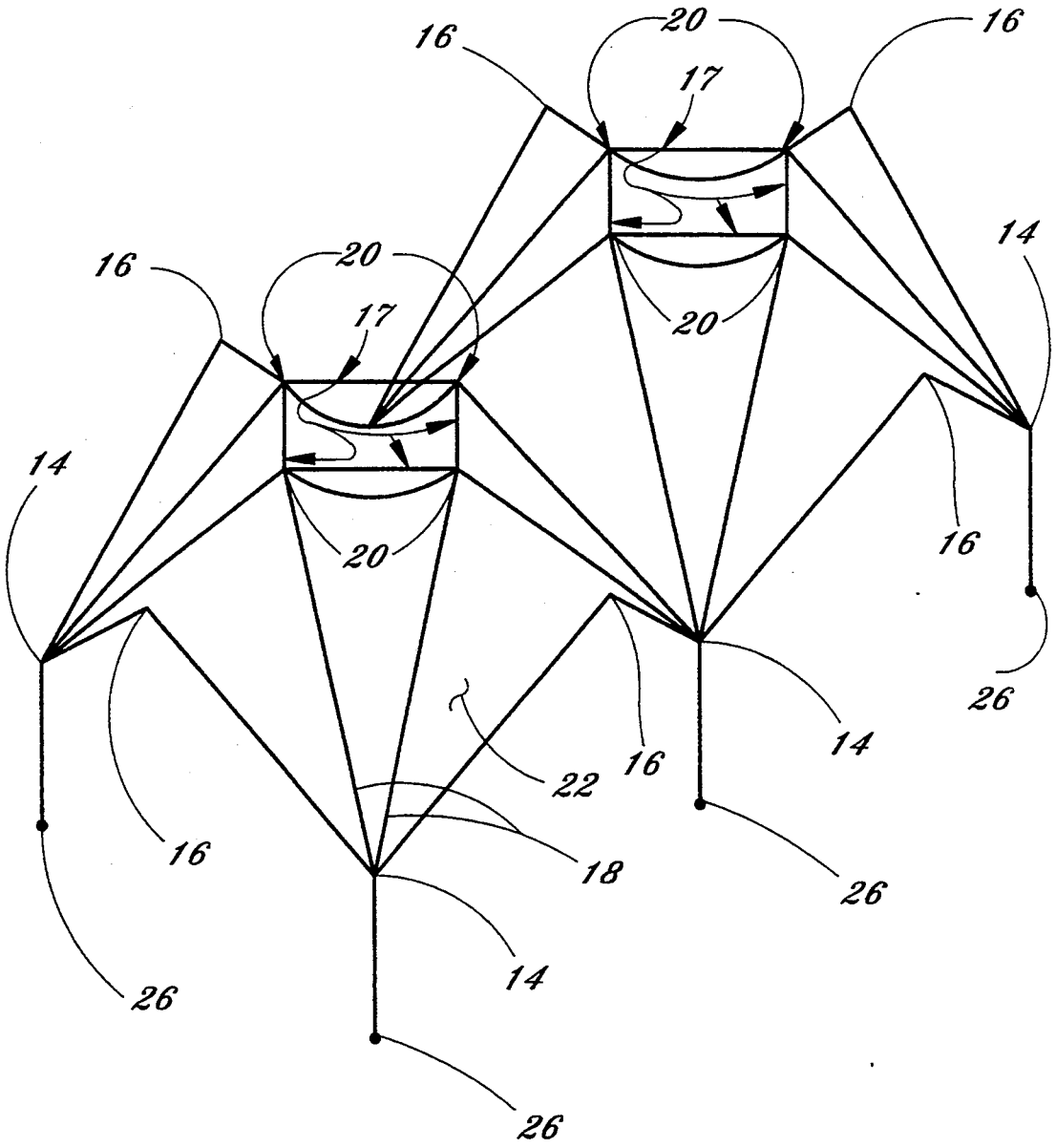
FIG. 3 is an isometric view of two octagonal tent structures joined together at common coupling points.
Figure 4:
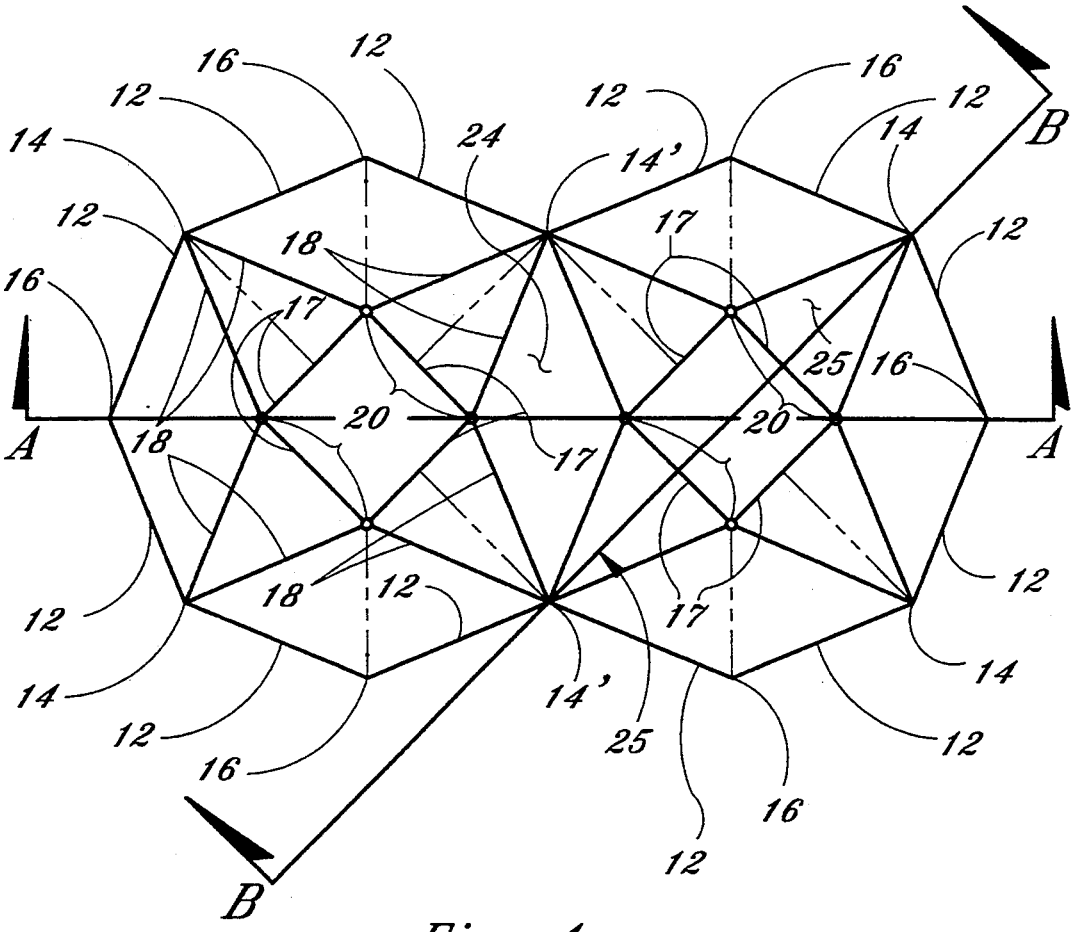
FIG. 4 is a plan view of two octagonal tent structure joined together at common coupling points.
Figure 5:
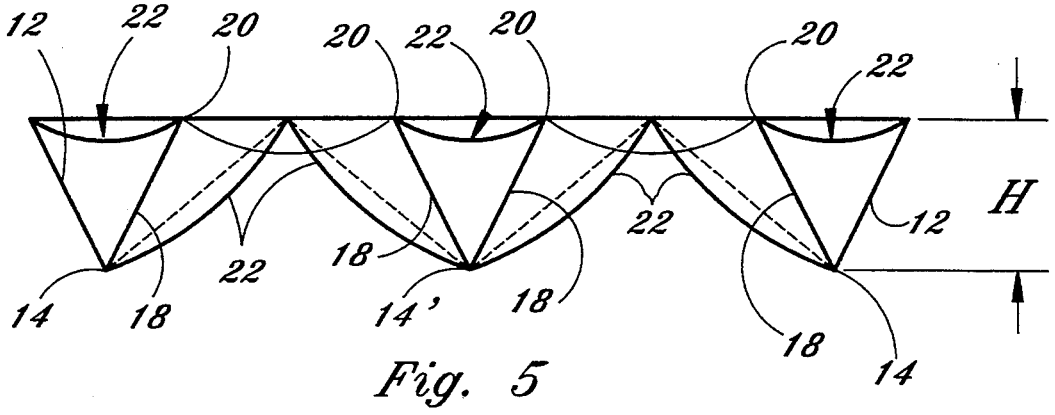
FIG. 5 is a sectional view of the embodiment in FIG. 4.
Figure 6:
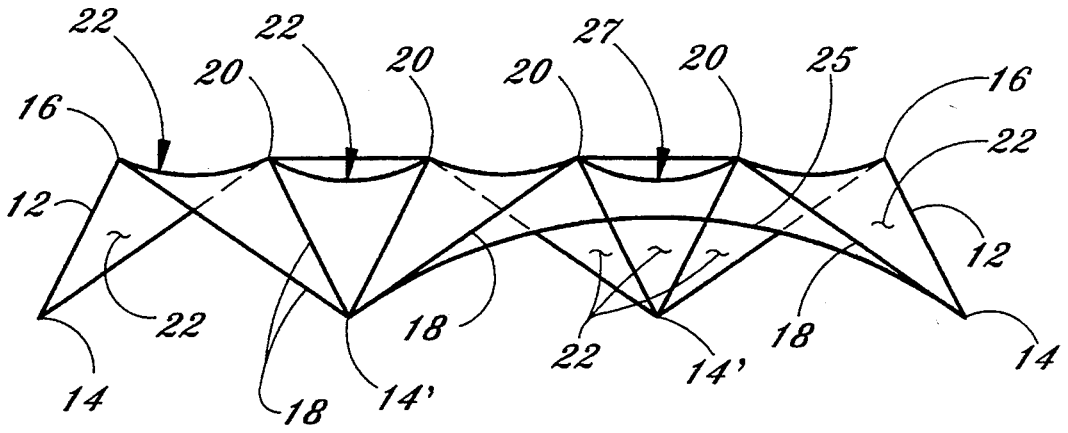
FIG. 6 is a sectional view of the embodiment in FIG. 4.

Referring now to FIGS. 1 and 2, there are depicted plan and sectional views of a single octagonally shaped structure 10 which may be joined into several structures at common points as shown in FIG. 3. The basic structure comprises eight elongated support members 12 of equal length which extend from four apical couplings 14 disposed coplanar relative to a support surface or plane, to four apical couplings 16 which are oriented in a coplanar arrangement a distance H above the support surface. The support members may be constructed from material such as steel, aluminum, plastic or composites. Four pairs of elongated support members 18 of equal length each extend from a respective coupling 14 to adjacent apical couplings 20 which define a square disposed coplanar with coupling 16, and situated on phantom radials coincident with coupling 16. Couplings 16 are attached to one another by four elongated support members 17. A covering fabric 22 may be hung beneath, draped over, or sandwiched in layers around the structure, and attached to the upper structure apical couplings by frame, for example, suspension rings 24 and the lower couplings, drawn to define a plurality of curved sections which can best be seen in the sectional view depicted in FIG. 2. The inverted curvature of these sections in combination with the cavities 26 defined by this geometry reduce the tendency for the covering 22 to lift away from the frame due to aerodynamic lift induced by pressure differentials between the interior and exterior of the tent in strong winds. The covering may be fabricated from a flexible material such as woven or extruded skins of cotton, canvas, polyethylene, acrylic ester, vinyl, glass, or similar materials.

Referring now to FIGS. 3, 4, 5 and 6, two individual structures 10 are joined together at common apical couplings 14' on the support surface capable of joining six support members. Note that in the triangular section 24 defined by the union, support members 12 are replaced by support members 18 from the adjacent structure. In this manner, a large number of structures may be joined together at common apical couplings. Curved brace members 25 and 27 are disposed between diametrically opposed coupling points to impart overall structural rigidity and to minimize the likelihood of structural failure. Stands 26 may be attached to lower coupling points 14 to elevate the entire assembly a distance above the support surface to permit greater space utilization.

Figure 7:
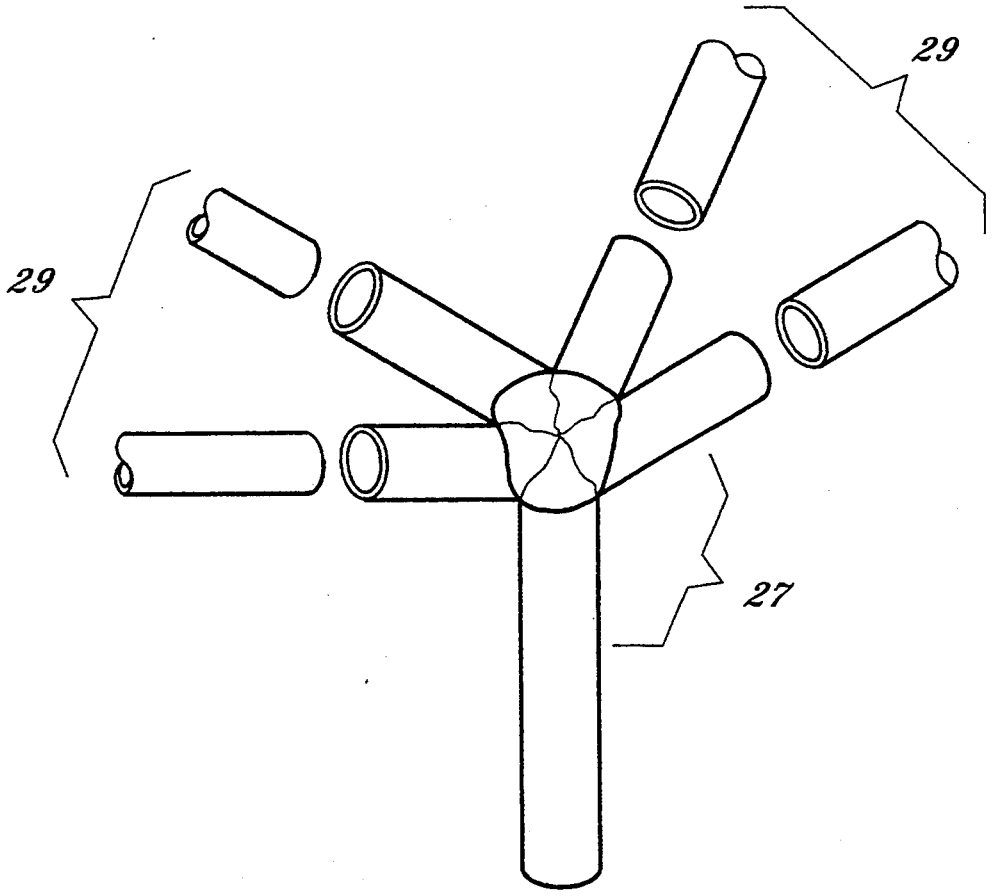
FIG. 7 is a view of a representative apical coupling point.

Referring now to FIG. 7, a representative coupling point for attaching several support members is depicted. This may be accomplished by providing a universal fitting 27 which accommodates the individual support members 29 in predetermined angular relationship dependent upon how many support members are joined at the particular joint, the fitting having a series of short tubes extending therefrom, each having an internal bore to accept the respective support member.

Figure 8:
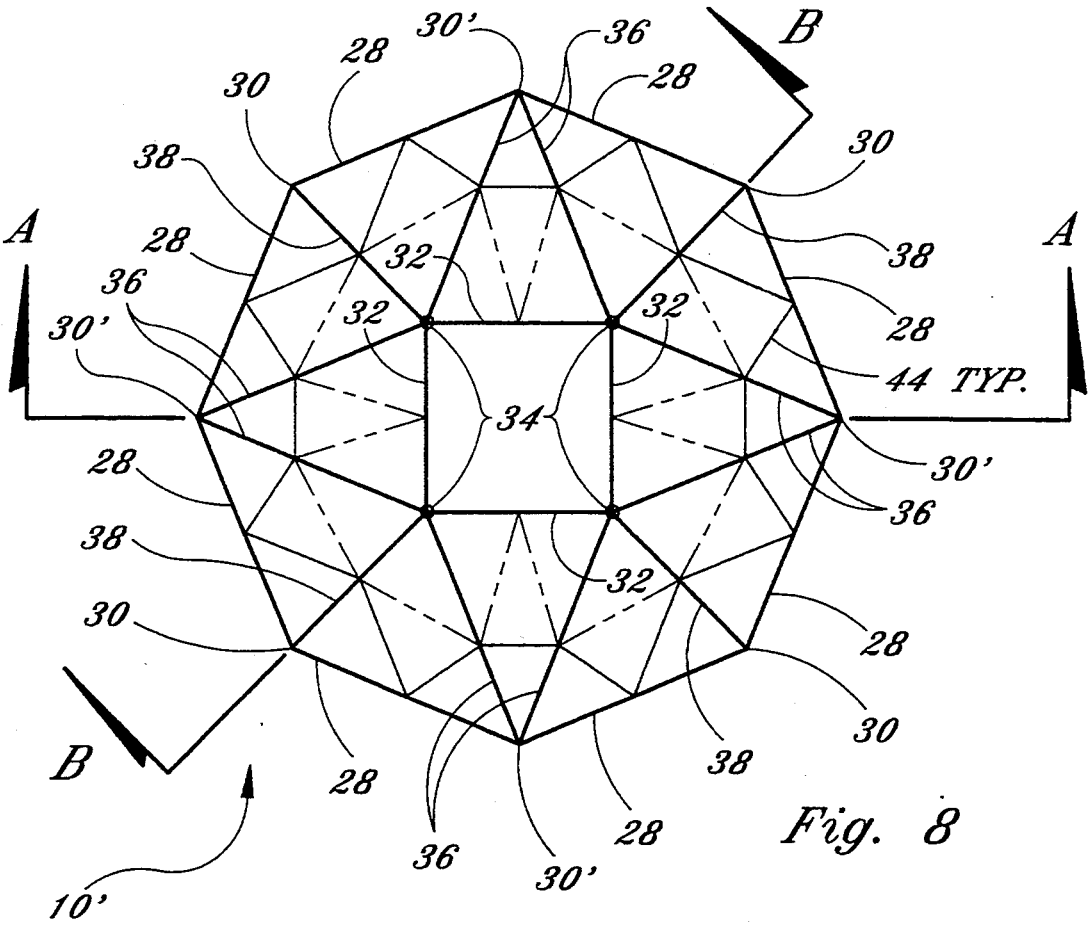
FIG. 8 is a plan view of an alternative octagonal-shaped tent module.
Figure 9:
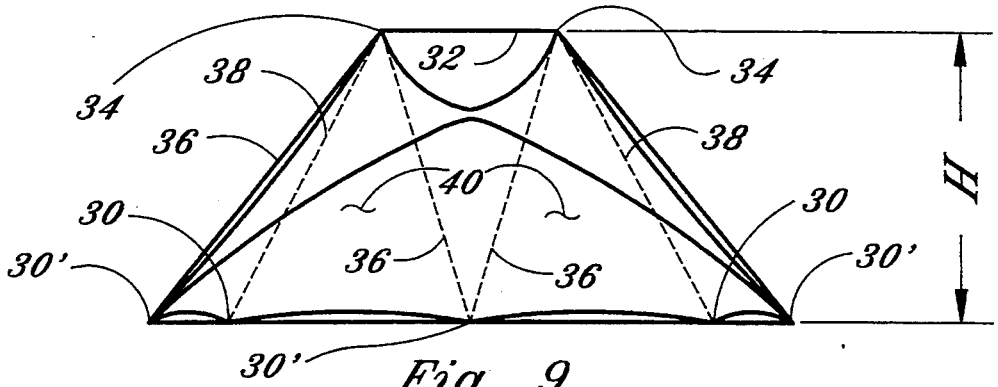
FIG. 9 is a sectional view of the embodiment in FIG. 8.
Figure 10:
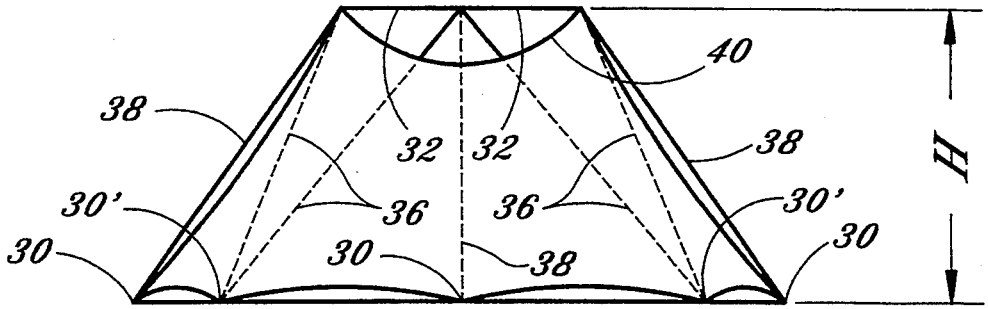
FIG. 10 is a sectional view of the embodiment in FIG. 8.

Referring now to FIGS. 8, 9 and 10, a second embodiment of the octagonal-shaped tent structure 10' is depicted, which is adapted to stand alone as an individual unit. Tent 10' comprises a base structure having eight elongated support members 28 joined at eight apical coupling points, four denoted by the reference numeral 30 which accommodate three support members, and four denoted by the reference numeral 30' which accommodate four support members. The base is arranged in the shape of an octagon and adapted to rest on a support surface. A square-shaped upper support structure is disposed in a plane parallel to the support surface, and elevated a distance H to provide suitable interior space. The upper support structure is comprised of four elongated support members 32 joined at four apical coupling points 34. Each coupling point 34 has a pair of elongated support members 36 extending downwardly to coupling points 30' and a single elongated support member 38 similarly extending downwardly in the middle of each support member 36 to coupling points 30. A covering fabric 40 may be hung beneath, draped over, or sandwiched in layers around the structure and attached thereto in like manner to the first embodiment by frame suspension rings 42 and the lower couplings, drawn to define a plurality of curved sections as best seen in the sectional view in FIGS. 9 and 10. If necessary for adequate structural rigidity in the case of a very large structure, a plurality of secondary frame members 44 may be added as shown in the plan view.

Figure 11:
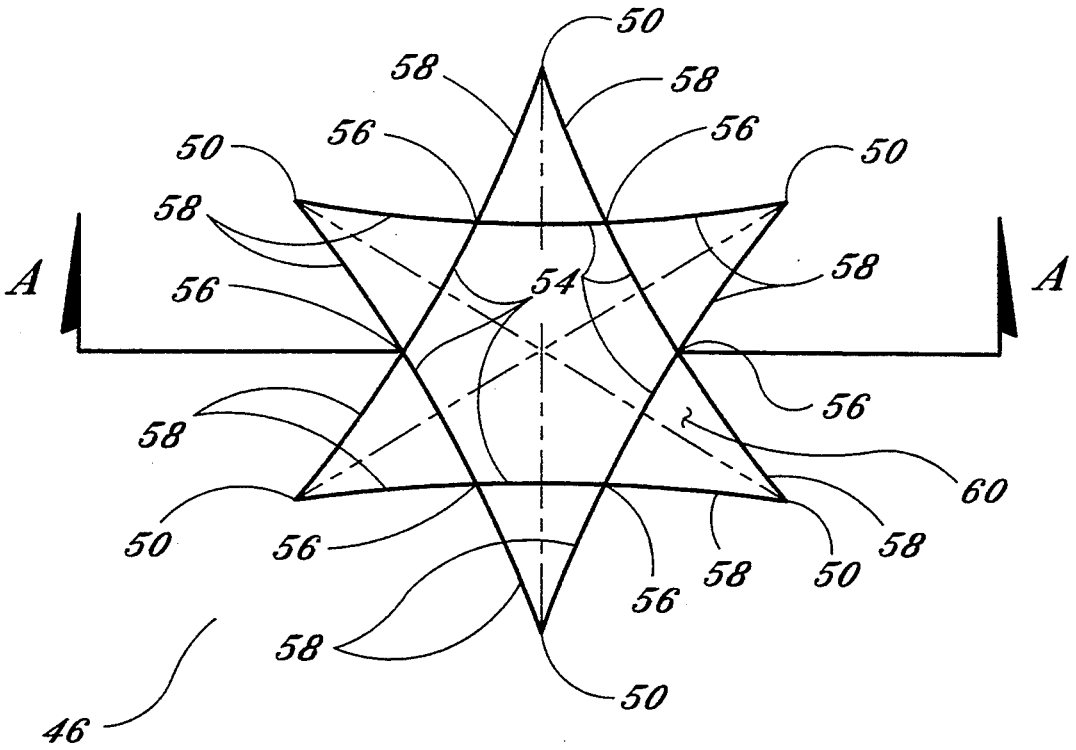
FIG. 11 is a plan view of a single hexagonal tent structure.
Figure 12:
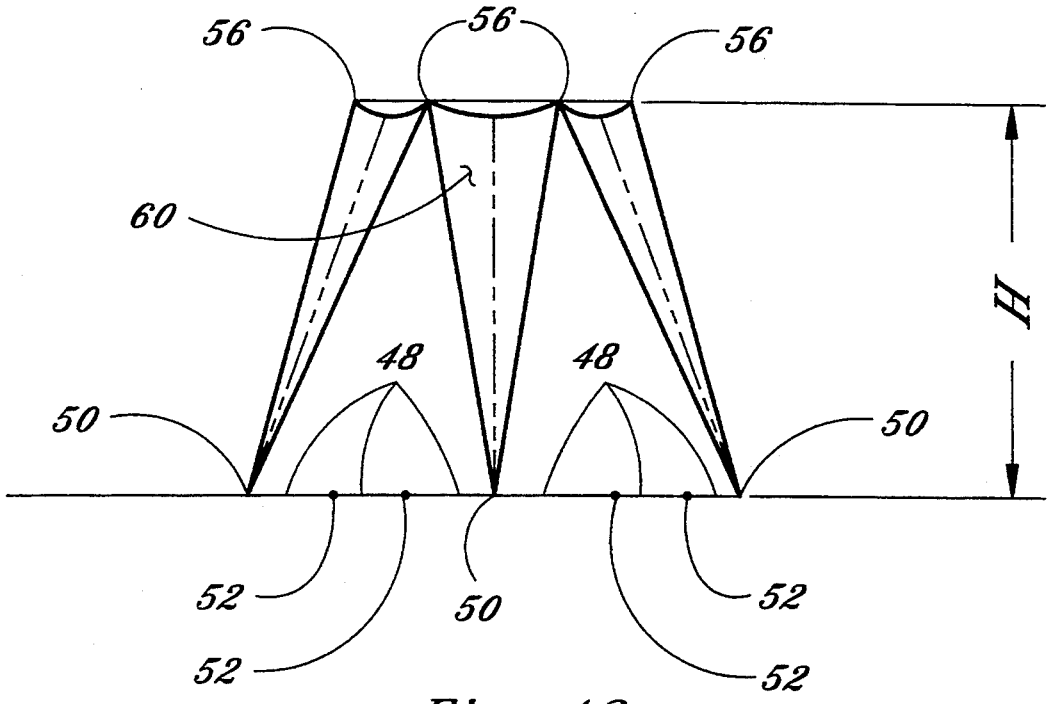
FIG. 12 is a sectional view of the embodiment in FIG. 11.

Referring to FIGS. 11 and 12, a single six-sided tent 46 is depicted, comprising a base adapted to rest on a support surface arranged in the shape of a six-pointed star when viewed from above in planform, the base consisting of twelve elongated support members 48 joined at six apical coupling points 50 and six inner base points 52. A hexagonal-shaped upper support structure is disposed in a plane parallel to the support surface and is elevated a distance H to provide suitable interior space. The upper support comprises six elongated support members 54 joined together at six apical coupling points 56. Extending downwardly to base couplings 50 from upper support structure couplings 56, are twelve elongated support members 58 which define the vertical structure as six points of a star when viewed from above. A covering fabric 60 may be hung beneath, draped over, or sandwiched in layers around the structure and attached to the respective couplings in like manner to the other embodiments by frame suspension rings 62 and the lower couplings, drawn to define a plurality of curved sections as best illustrated in the sectional view in FIG. 12.

Figure 13:
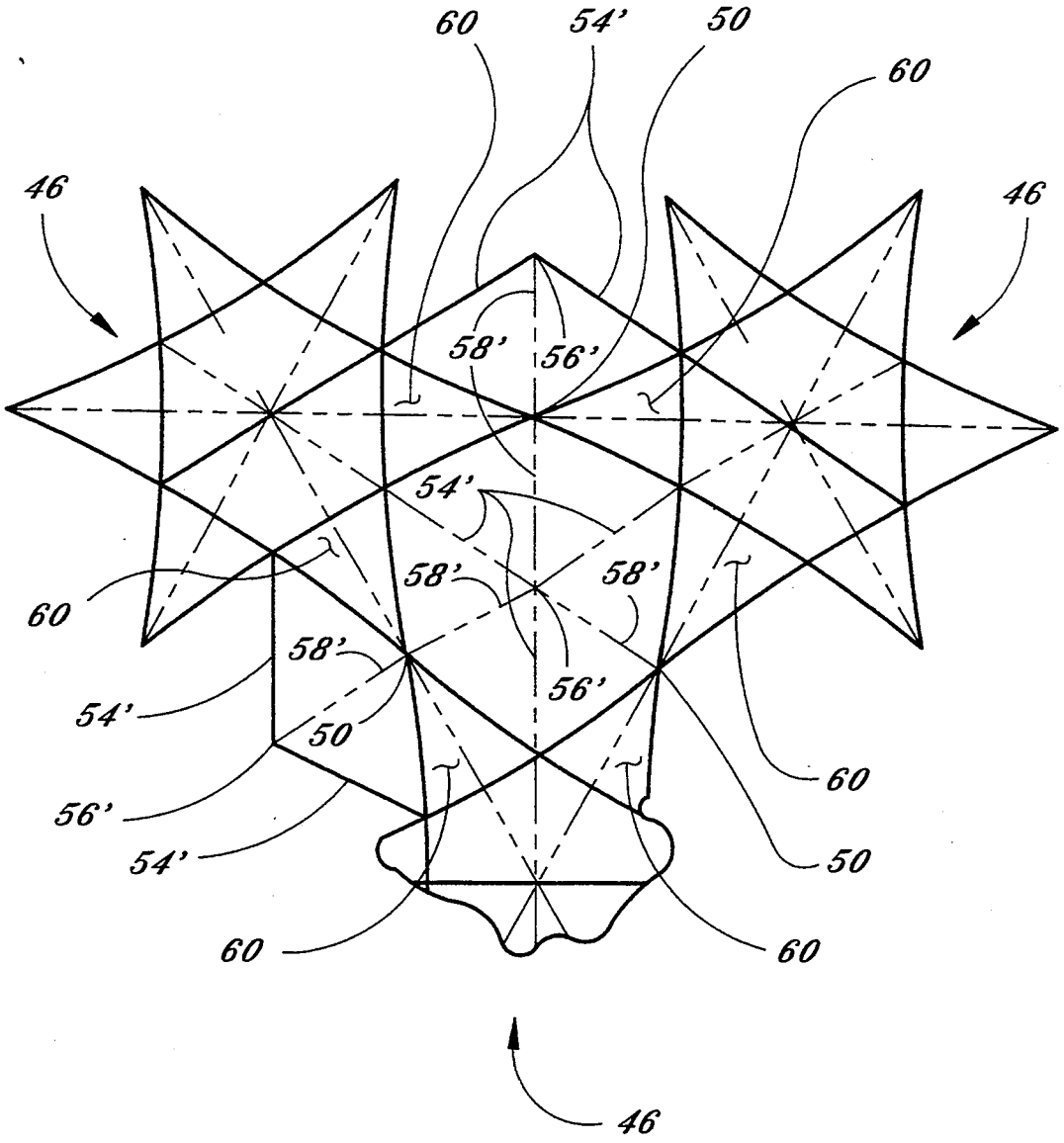
FIG. 13 is a plan view of a plurality of hexagonal structures joined together at common coupling points.

Referring now to FIG. 13, a plurality of six-sided tents 46 are joined together into a larger assembly, at common coupling points 50'. To complete the structure, additional elongated support members 54' are added and joined at apical couplings 56' which define intermediate hexagonal-shaped upper support structures coplanar with the upper support structure of each tent 46 itself. Elongated support members 58' extend downwardly from couplings 56' to common couplings 50' where adjacent tents 46 are coupled. Covering fabric 60' is added to define inverted pyramidal-shaped areas which assist in geometrically canceling aerodynamic lift components on adjacent tent covering surfaces which may be induced by the wind.

Figure 14:
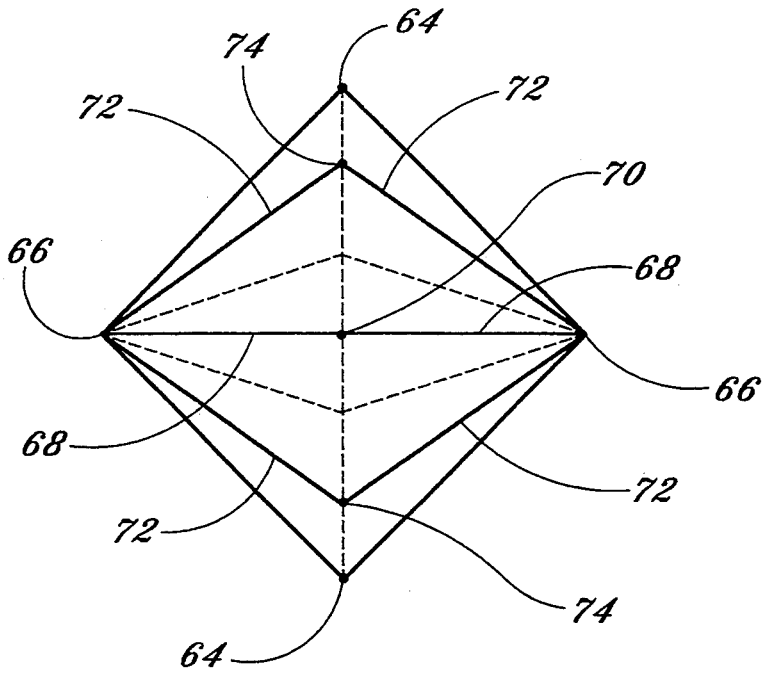
FIG. 14 is a plan view of a four-sided tent structure.
Figure 15:
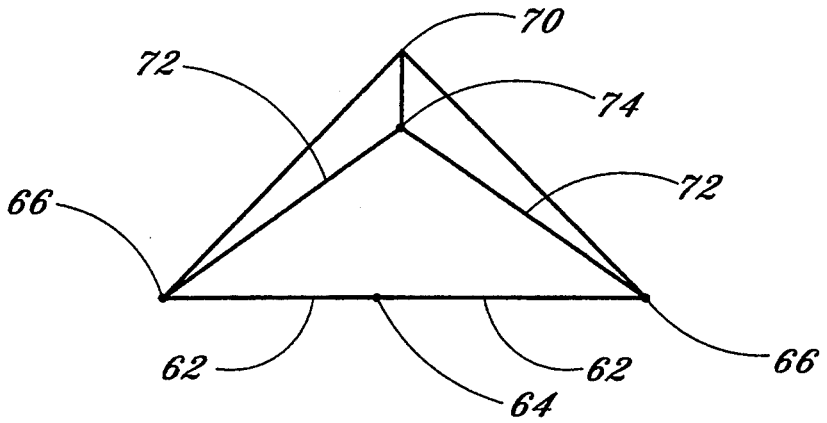
FIG. 15 is a frontal elevational view of the embodiment in FIG. 14.
Figure 16:
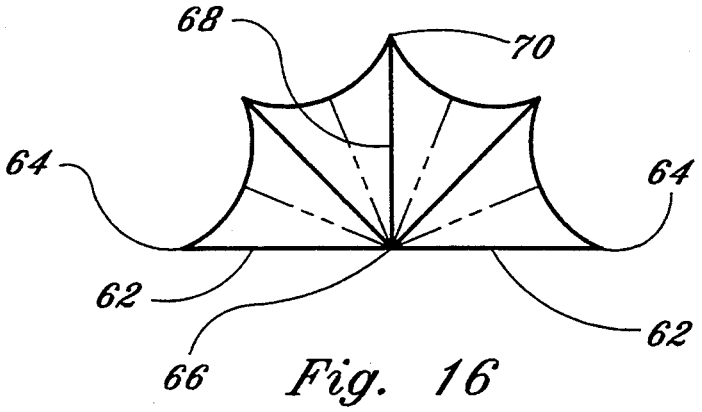
FIG. 16 is a side elevational view of the embodiment in FIG. 14.

Referring now to FIGS. 14, 15 and 16, a four-sided embodiment 60 of the tent is disclosed, comprising a quadrilateral base adapted to rest on a support surface when viewed from above in planform, defined by four elongated support members 62 including two apical coupling points 64 for joining two support members 62 together, and two apical coupling points 66 for joining members 62 and the following support members. Elongated support members 68 extend upwardly from opposing coupling points 66 in a plane perpendicular to the support surface and define the highest point on the structure, elevated a distance H and joined at apical coupling point 70. Situated on planes 45° from the plane perpendicular to the support surface, are elongated support members 72 which similarly extend upwardly from coupling points 66, and terminate at apical coupling point 74, each pair of support members 72 and associated coupling point 74 in mirror image relationship about the plane normal to the support surface through coupling point 66. A covering fabric 76 may be hung beneath, draped over, or sandwiched in layers around the structure and attached thereto in a manner similar to the other embodiments by frame suspension rings 78 and the lower couplings, drawing to define a plurality of curved sections as best illustrated in the side elevational view depicted in FIG. 16.

Figure 17:
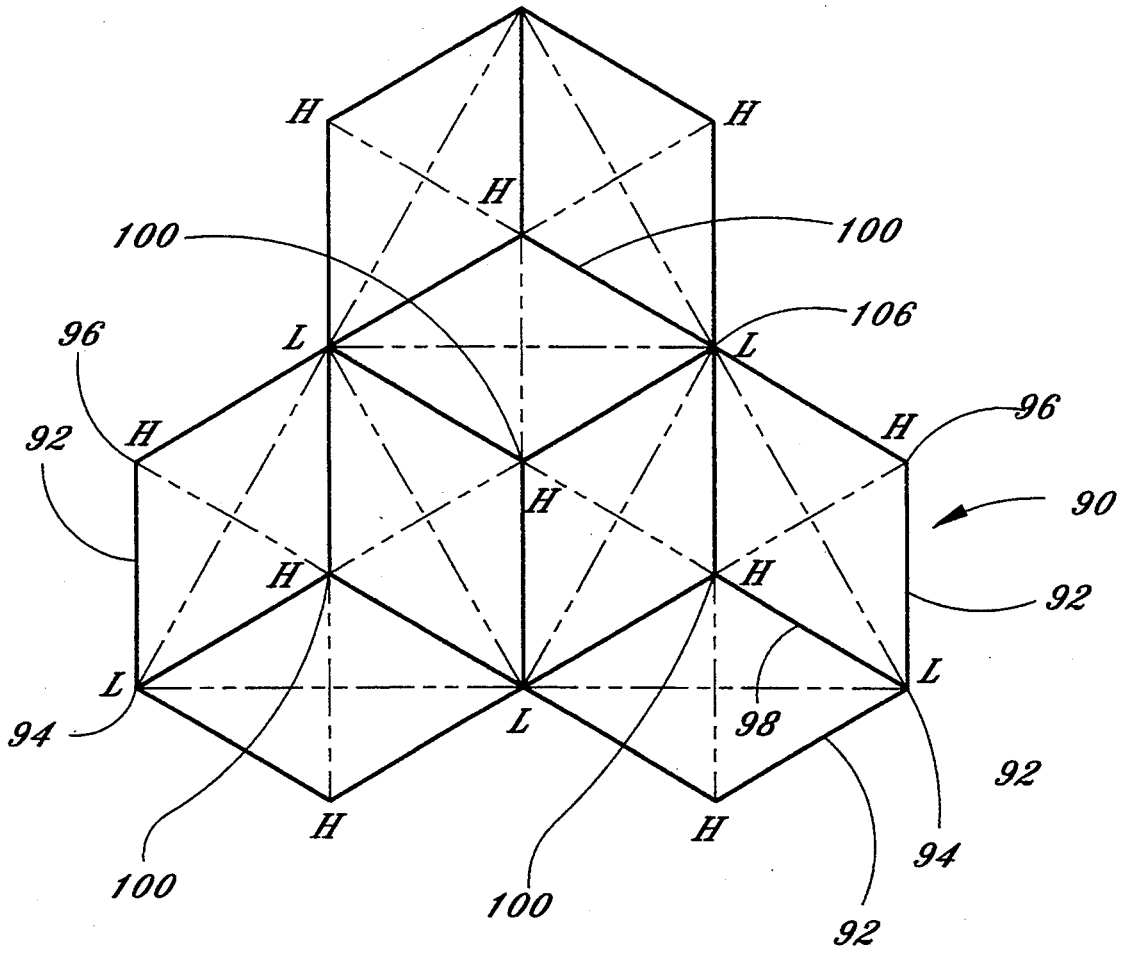
FIG. 17 is a top plan view of second embodiment of the six sided tent structure.
Figure 18:
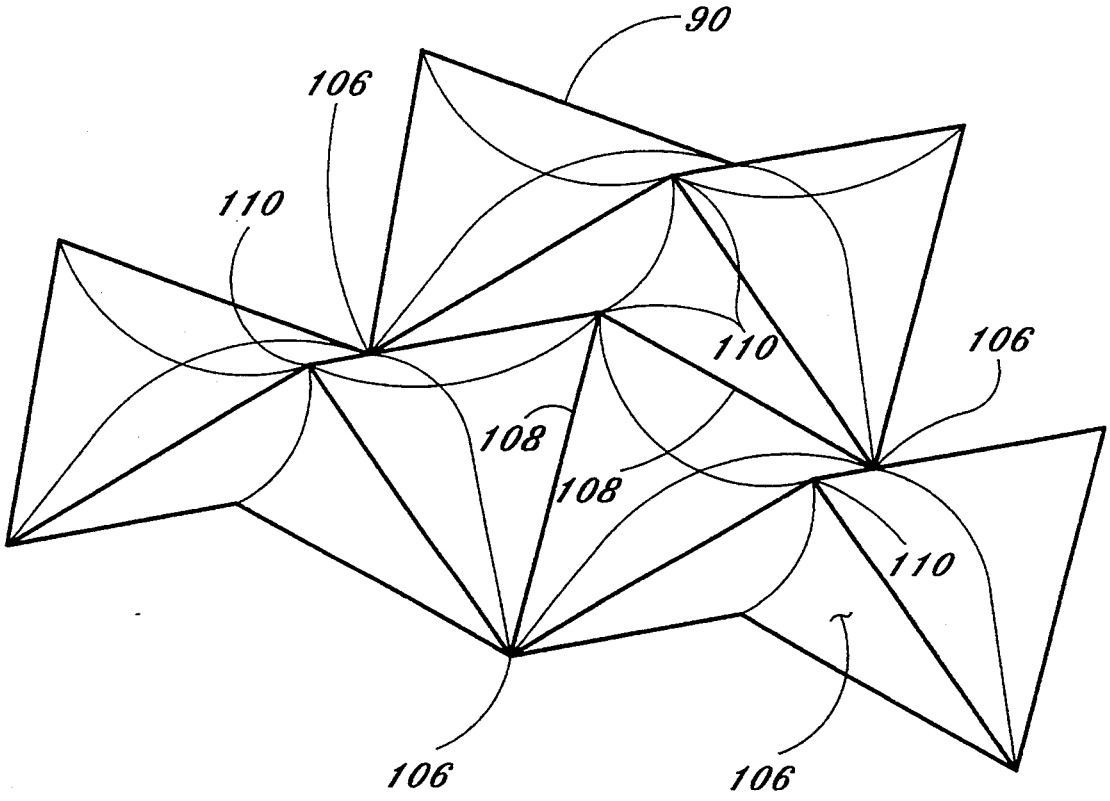
FIG. 18 is a top plan view of the tent structure of FIG. 17 with a fabric covering.

Referring now to to FIGS. 17 and 18, a six-sided tent 90 is depicted, comprising a base adapted to rest on a support surface arranged in the shape of a three point support when viewed from above in planeform, the base consisting of six elongated support members 92 joined at three apical coupling points 94 and three inner base points 96. A hexagonal-shaped upper support structure is disposed in a plane parallel to the support surface and is elevated a distance H to provide suitable interior space. The upper support comprises three elongated support members 98 joined together at one apical coupling points 100. Extending downwardly to base couplings 102 from upper support structure couplings 100, are three elongated support members 98 which define the vertical structure as three points of a star when viewed from above. Covering fabric 104 may be hung beneath, draped over, or sandwiched in layers around the structure and attached to the respective couplings in like manner to the other embodiments by frame suspension rings and the lower couplings, drawn to define a plurality of curved sections as best illustrated in the sectional view in FIG. 18. A plurality of six-sided tents 90 are joined together into a larger assembly, at common coupling points 106. To complete the structure, additional elongated support members 108 can be added and joined at apical couplings 110 which define intermediate hexagonal-shaped upper support structures coplanar with the upper support structure of each tent 90 itself. Elongated support members 108 extend downwardly from couplings 110 to couplings 106 where adjacent tents 90 are coupled. Covering fabric 104 is added to define inverted pyramidal-shaped areas which assist in geometrically canceling aerodynamic lift components on adjacent tent covering surfaces which may be induced by the wind. The covering fabric creates parabolic curves in the fabric as drawn between the raised points and base support members. For purposes of example only, the tent structure of the instant embodiment employs each connecting member at five foot ten inches.

The present invention has been disclosed in what is considered to be the most practical and preferred embodiment. It is anticipated, however, that departures may be made therefrom, and that obvious modifications will occur to a person skilled in the art.

What I claim is:

1. A geodetic tent, comprising:

a first group of four apical coupling points disposed in coplanar relationship, and adapted to rest on a support surface;

a second group of four apical coupling points disposed in coplanar relationship an elevated distance above said first group of apical coupling points;

a third group of four apical coupling points disposed coplanar with said second group of apical coupling points, said third group of four apical coupling points defining a square area bounded by a group of four elongated support members of equal length;

a first group of eight elongated support members of equal length, each of which extending from each of said first group of apical coupling points to each of said second group of apical coupling points;

a second group of eight elongated support members of equal length, two of each extending upwardly from each of said first group of apical coupling points to adjacent apical coupling points in said third group; and a covering fabric suspended between said apical coupling points and drawn into a plurality of curved sections.

* * * * *